US005386969A

United States Patent [19]

Popowich

[11] Patent Number: 5,386,969

[45] Date of Patent: Feb. 7, 1995

[54] PLASTIC LOAD REST FOR A JACK

[75] Inventor: David J. Popowich, Toronto, Canada

[73] Assignee: Ventra Group Inc., Ontario, Canada

[21] Appl. No.: 246,080

[22] Filed: May 19, 1994

[51] Int. Cl.[6] ..... B66F 3/12

[52] U.S. Cl. ..... 254/133 R; 254/126; 254/DIG. 4

[58] Field of Search ..... 254/126, 122, 124, 101, 254/133, 134, DIG. 4

[56] References Cited

U.S. PATENT DOCUMENTS

| | | | |
|---|---|---|---|
| 1,701,314 | 2/1929 | Shook . | |
| 4,194,725 | 3/1980 | Erschens . | |
| 4,289,300 | 9/1981 | Weisser et al. | 254/126 |
| 4,848,733 | 7/1989 | Yamauchi . | |
| 5,135,201 | 8/1992 | Engel . | |
| 5,199,688 | 4/1993 | Engel | 254/126 |
| 5,217,206 | 6/1993 | Brosius et al. | 254/126 |

FOREIGN PATENT DOCUMENTS

| | | |
|---|---|---|
| 2936002 | 8/1979 | Germany . |
| 3033956 | 6/1982 | Germany . |
| 2145392 | 3/1985 | United Kingdom . |

*Primary Examiner*—Robert C. Watson
*Attorney, Agent, or Firm*—Cushman, Darby & Cushman

[57] ABSTRACT

An integral plastic load rest for a pantograph jack having a laterally extending channel to engage a vehicle and a reinforced seat centrally positioned under the channel to transfer vehicle load to the jack while allowing clearance for the jack teeth.

1 Claim, 3 Drawing Sheets

PLASTIC LOAD REST FOR A JACK

BACKGROUND OF THE INVENTION

This invention relates to a lifting jack for automobiles and other vehicles. More particularly, it relates to an improvement in the construction of the load rest.

A portable jack is often stored in a vehicle to enable a driver to lift the vehicle to effect emergency repairs, for example, to change a tire. In order to satisfy safety requirements it is necessary that a jack hold an automobile in an elevated position under a number of offsetting conditions. For example, the jack must have certain stability under longitudinal or lateral loading conditions and stability when elevating an automobile on surfaces that may be inclined in any direction.

The shape and dimensions of a load rest make an important contribution to jack stability. It is important that a load rest should engage with a vehicle sufficiently to secure it in place against slippage under various conditions while still facilitating quick and easy use by an unskilled operator with minimal instruction. A load rest should also interface with a vehicle to resist rolling or yawing under the vehicle to resist movement of the vehicle that might upset the jack.

One example of a prior art load rest is found in U.S. Pat. No. 5,135,201 which discloses a two piece load rest in which a bracket connects to a lift cap with tabs that fit through slots therein. Other examples of prior art load rests are disclosed in U.S. Pat. Nos. 4,194,725, 1,701,314 and 4,848,733; German patents 2,936,002 and 3,033,956 and Great Britain Patent 2,145,392.

The present invention discloses an integral plastic load rest that, in comparison with competitive two piece metal rests, has the advantages of reduced weight and one piece construction.

SUMMARY OF THE INVENTION

The present invention is an integral plastic load rest to be fastened to an upper portion of a pantograph jack, comprising:

a laterally extending channel sized to engage a downwardly projecting vehicle lip (e.g., a weld flange), said channel lying between a low shoulder and a high shoulder to assist in location of the channel under said vehicle lip;

first and second flanges spaced apart laterally to bracket a saddle portion of said upper portion of a jack, each said flange having a pair of holes to receive fasteners to connect the load rest to said saddle and each said flange having a central, outwardly extending buttress underlying said channel;

a reinforced seat centrally positioned under said channel to transfer vehicle load to the saddle of the jack; and clearance gaps positioned on either side of said seat under said channel to permit jack gear teeth to turn under the load rest as the jack is raised or lowered.

BRIEF DESCRIPTION OF THE FIGURES

In the figures which illustrate a preferred embodiment of the present invention.

DESCRIPTION OF PREFERRED EMBODIMENT

In the figures which illustrate the preferred embodiments of this invention, like numerals indicate like elements.

The load rest (10) of this invention is one integral moulded plastic part. It will be apparent to those skilled in the art of fabricating plastic parts that certain types of plastic have sufficient strength to sustain the forces created by the loads exerted on the jack by the weight of a vehicle. It will also be apparent that design loads for a load rest will be predetermined from specifications of the type and weight of a vehicle to be supported.

Figure 1:
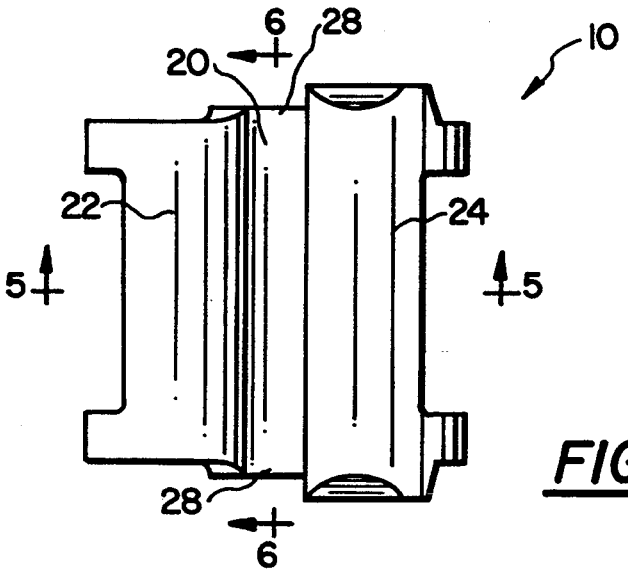
FIG. 1 is an plan view.
Figure 2:
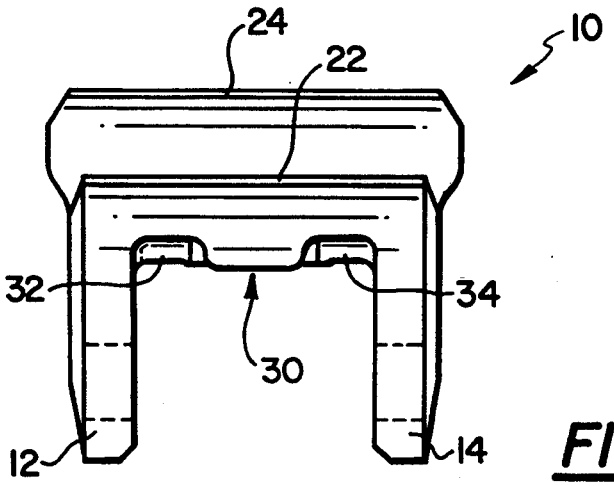
FIG. 2 is a front view.
Figure 3:
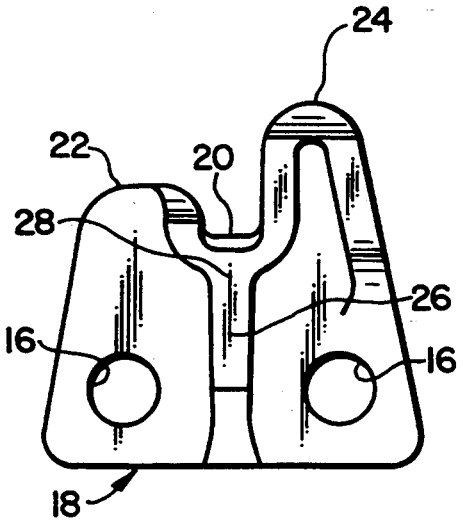
FIG. 3 is an side view.

The load rest (10) of this invention is adapted to be fastened to an upper portion or saddle of a pantograph jack (not shown). As best illustrated in FIG. 2, the load rest (10) has downwardly extending first and second flanges (12 and 14) spaced apart laterally to bracket the saddle. As shown in FIG. 3, the flanges (12 and 14) each have a pair of holes (16) to receive fasteners, such as rivets or bolts, to connect the load rest (10) to the saddle. The flanges (12 and 14) extend longitudinally so that the bottom end (18) forms the longest dimension of the load rest (10) which, in a side view, assumes an approximately trapezoidal shape.

The preferred embodiment of the load rest (10) also has a laterally extending channel (20). The channel (20) is sized to receive a flange or lip extending from the underside of the vehicle. As shown in FIG. 3, the channel (20) is banked by a low shoulder (22) and a high shoulder (24) to assist in location of the channel under said vehicle lip. As the jack is raised to a position close to the lip under the vehicle, the low shoulder (22) will slide under the lip while the high shoulder (24) will abut against it. As a result, the shoulders (22 and 24) tend to be useful to locate the channel (20). The tops of the shoulders (22 and 24) are rounded for strength and to help guide a lip into the channel (20).

Figure 7:
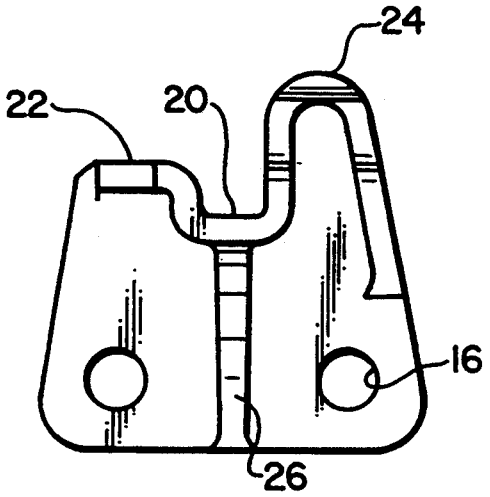
FIG. 7 is a side view of another embodiment of this invention having extended channels.
Figure 8:
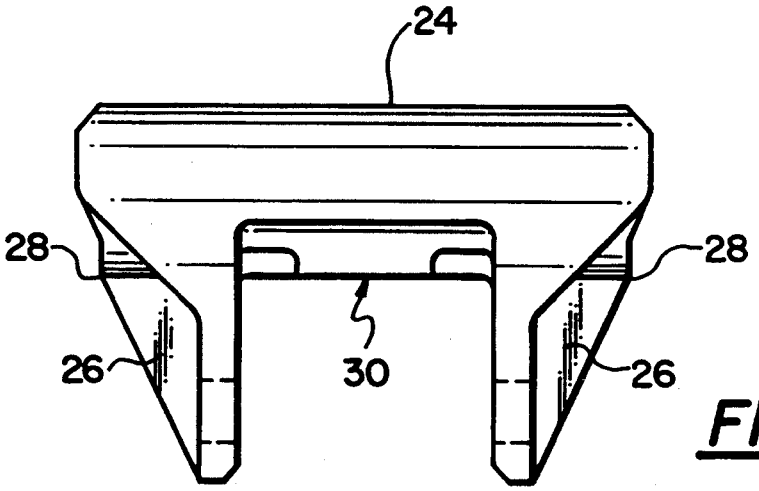
FIG. 8 is a rear view of the embodiment shown in FIG. 7.

Each of the flanges (12 and 14) has a buttress (26) centrally located under the channel (20) that reinforces the edges (28) of the channel (20) against breakage. In another embodiment shown in FIGS. 7 and 8, the buttress (26) is extended laterally outward as the channel (20) is extended laterally outward of the flanges (12 and 14) to support the edges (28).

Figure 4:
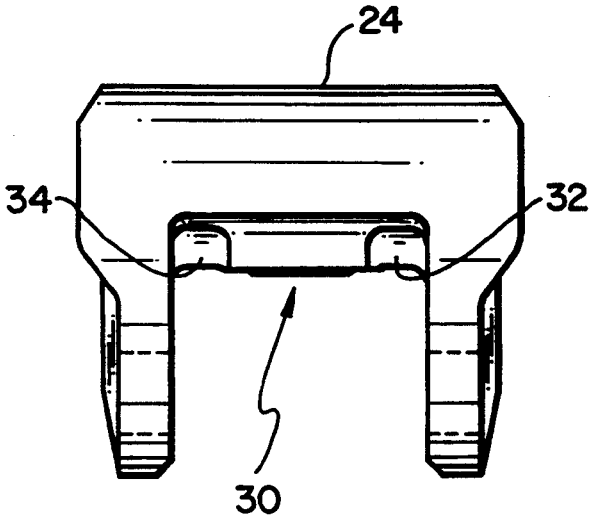
FIG. 4 is a rear view.
Figure 5:
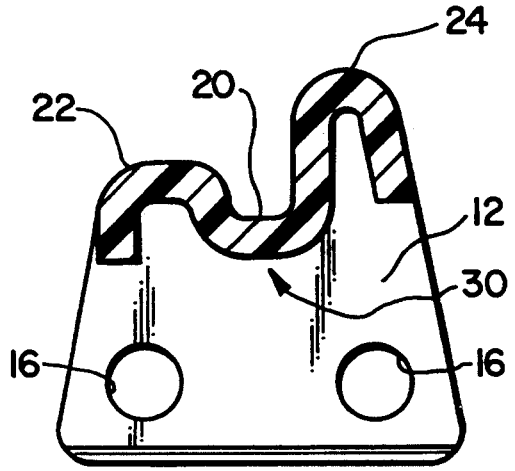
FIG. 5 is a sectional view taken along section 5—5 in FIG. 1.
Figure 6:
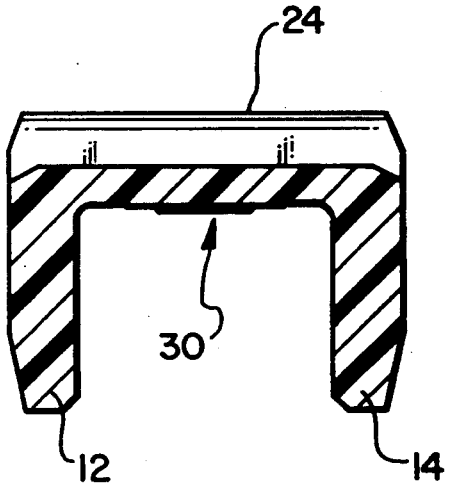
FIG. 6 is a sectional view taken along section 6—6 in FIG. 1.

As shown in FIGS. 2, 4 and 6 a reinforced seat (30) is centrally positioned under the channel (20) to transfer vehicle load to the saddle of the jack. As shown in FIGS. 2 and 4, clearance gaps (32 and 34) are positioned on either side of said seat under said channel to permit jack gear teeth under the load rest to turn through its underside to obtain lower elevation or profile of the jack.

The description of the preferred embodiments of this invention are intended to be illustrative and not limiting of this invention which is further described and claimed in this specification.

I claim:

1. An integral plastic load rest to be fastened to an upper portion of a pantograph jack comprising:

a laterally extending channel sized to engage a downwardly projecting vehicle lip, said channel lying between a low shoulder and a high shoulder to assist in location of the channel under said vehicle lip;

first and second flanges spaced apart laterally to bracket a saddle portion of said upper portion of a jack, each said flange having a pair of holes to receive fasteners to connect the load rest to said saddle and each said flange having a central, outwardly extending buttress underlying said channel;

a reinforced seat centrally positioned under said channel to transfer vehicle load to the saddle of the jack; and clearance gaps positioned on either side of said seat under said channel to permit jack gear teeth to turn under said load rest.

* * * * *